US006837769B1

(12) United States Patent
Skov et al.

(10) Patent No.: US 6,837,769 B1
(45) Date of Patent: Jan. 4, 2005

(54) TOY FIGURE AND A GAME COMPRISING SUCH TOY FIGURE

(75) Inventors: Ib Torben Skov, Billund (DK); Erik Legernes, Vejle (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 10/424,602

(22) Filed: Apr. 28, 2003

(51) Int. Cl.[7] ..... A63H 13/10

(52) U.S. Cl. ..... 446/139; 446/308; 446/379; 273/317.3

(58) Field of Search ..... 273/129 R, 317, 273/317.3; 124/4, 6; 446/137, 138, 139, 308, 330, 376, 379, 380, 382

(56) References Cited

U.S. PATENT DOCUMENTS

| | | | | |
|---|---|---|---|---|
| 1,982,491 A | | 11/1934 | Barnum | |
| 2,296,541 A | * | 9/1942 | Schuyler | 40/419 |
| 2,799,501 A | | 7/1957 | Barbolla | |
| 2,827,035 A | | 3/1958 | Modica, Jr. | |
| 2,911,758 A | * | 11/1959 | Carson | 446/308 |
| 4,205,482 A | | 6/1980 | Ozawa | |
| 4,985,008 A | * | 1/1991 | Price | 446/308 |
| 5,690,330 A | | 11/1997 | Christiansen et al. | |
| 6,129,606 A | | 10/2000 | Yuen | |
| 6,171,169 B1 | | 1/2001 | Saunders | |
| 6,273,779 B1 | | 8/2001 | Boulaire | |

FOREIGN PATENT DOCUMENTS

| | | | |
|---|---|---|---|
| DE | 2 304 179 | | 1/1973 |
| GB | 1 299 619 | | 6/1970 |
| GB | 1 426 178 | | 4/1972 |
| US | 2003/0166374 | * | 9/2003 |
| WO | WO 01/02069 A1 | | 1/2001 |

* cited by examiner

*Primary Examiner*—Jacob K. Ackun, Jr.
(74) *Attorney, Agent, or Firm*—Pitney Hardin LLP

(57) ABSTRACT

Human-like toy figure (1) comprising a body (3) and legs (4) that are, in the upright position of the toy figure, configured such in relation to each other that the body (3) is turnable about an essentially horizontal axis (A). In connection with the body (3) means are provided for temporarily securing an object (21); and the toy figure (1) is provided with a spring device that seeks to keep the body (3) upright, but allows the body (3) to swing resiliently both forwards and backwards about the axis (A). Also a game comprising such toy figure (1) and at least one goal and an object (21) intended to be thrown towards the goal by the toy figure.

16 Claims, 4 Drawing Sheets

TOY FIGURE AND A GAME COMPRISING SUCH TOY FIGURE

The invention relates to a human-like toy figure comprising a body and legs, configured such in relation to each other that, in the upright position of the toy figure, the body is turnable about an essentially horizontal axis, in which toy figure there is, in connection with the body, provided means for temporarily securing an object.

The invention also relates to a game comprising at least one goal and at least one human-like toy figure comprising a body and legs and an object intended to be thrown towards the goal by the toy figure.

A toy figure as described above is known ia from U.S. Pat. No. 4,205,482, showing a toy figure for a toy building set, said toy figure comprising a body, two legs, two arms and a head. The body is turnable relative to the legs about an axis in the hip of the toy figure, thereby enabling the toy figure to stand as well as sit. The legs are provided with coupling means in the form of cavities that will frictionally receive coupling studs located on another toy building element and in this manner create a temporary attachment between the toy figure and the other toy building element. The arms of the toy figure are able to rotate about a horizontal axis and are provided with "hands" that are able to temporarily secure an object by squeezing.

This toy figure is able to perform many human-like movements and is ia able to seize an object with its "hands" and temporarily secure it. However, it is not configured for being able to throw the object away from itself and it is hence not possible for the toy figure to play an active part of a throwing game or a game in which an object is to be thrown.

A game like the one described above is known ia from U.S. Pat. No. 6,171,169 disclosing a game comprising a toy figure configured for temporarily securing a ball in its hands and for being able to throw this ball towards a goal, such as a basket ball hoop. This toy figure is configured with a spring-biased arm that can be rotated about a horizontal shoulder-joint axis; it occupying as a starting point a position in which it hangs down along the side of the body. Against a spring force the arm can be turned upwards to an upwardly pointing position and be secured therein by means of a locking mechanism. Now the ball can be arranged in its hand and by means of a releaser mechanism the arm can be released, following which the spring force causes it to pivot quickly downwards to the starting position while the ball is thrown towards the goal.

In this game the toy figure conveys a static impression of the throwing movement; it merely being the arm that moves during the throwing and due to the fact that it is not possible to perform variations of the throwing movement from one throw to another. Besides, the ball must be located manually in the hand of the toy figure.

It is the object of the invention to provide a toy figure that can be caused to pick up an object from a support and whereby a rather dynamic throwing movement can be obtained compared to the prior art toy figures, and a game of which such toy figure is a constituent.

This is obtained by providing the toy figure mentioned above with a spring device that strives to keep the body upright in relation to the legs, but allows the body to swing resiliently forwards as well as backwards about the axis; and by configuring the game described above with such toy figure.

Hereby it is obtained that, when an object is being thrown, the toy figure performs a dynamic movement in which the entire body participates in the throwing movement. It is also obtained that the toy figure is able to pick up an object from a support when it is bent forwards in a controlled manner, such that its means for temporarily securing the object are caused to engage with the object.

According to a preferred embodiment of the invention, the toy figure is provided with inflexible legs, while the spring device is provided between the body and the legs of the toy figure. In this embodiment the toy figure is configured in a very human-like manner; the resilient swinging of the body taking place about an axis through the hip portion of the toy figure.

The spring device preferably comprises at least one helical spring extending axially downwards into the legs and upwards into the body, respectively. Such helical spring is able to bend and stretch to follow the movement of the body relative to the legs, but it will always attempt to straighten the body to its upright position again.

According to an alternative embodiment the toy figure is provided with flexible legs; the spring device being constituted by these flexible legs. In this embodiment the swinging movement of the body is not accomplished around the hip portion, but rather about an axis situated at the lower parts of the legs.

The flexible legs can be accomplished by being manufactured from a flexible material. Preferably, however, they are constituted of a helical spring mounted underneath the body.

According to a preferred embodiment the means for temporarily securing an object are configured as two arms, such that a realistic toy figure is accomplished that is able to hold an object in its arms.

The arms can be configured either for being securely locked in specific positions in relation to the body or they may be securely mounted in relation to the body; and if the latter is the case they extend essentially straight from the body. This embodiment is particularly advantageous for ensuring that the arms occupy the correct position both for collecting and for temporarily securing the object.

The arms can be configured such that they form parts of a spherical indentation in which a spherical object is able to sit freely.

Alternatively and for securing an object by means of arms, the means for temporarily securing an object may comprise at least one permanent magnet. Such temporary securing makes fewer demands to the exact configuration of the holder mechanism than the above-referenced solution with a toy figure with protruding arms.

According to a preferred embodiment the toy figure is provided with coupling means underneath its legs, enabling it to be interconnected with a play board having complementary coupling means or with toy building elements in a toy building set.

The game according to the invention preferably comprises a game board, wherein the game board and the toy figure are configured with precisely such complementary coupling means; the coupling means of the toy figure being configured underneath the legs. Hereby the toy figure can be secured to the game board in a fixed position, or it can be moved around to different positions. The interconnection between the toy figure and the game board, however, serves to ensure that the toy figure is kept in place when the object is being thrown.

According to a preferred embodiment of the game according to the invention, the game board is provided with at least one rotatable turntable provided with the complementary coupling means of the game board. Thus, the toy figure can be mounted on this rotatable turntable and is thereby able to throw the object in all directions.

In order to ensure that the object is being located immediately in font of the toy figure, an indentation may advantageously be provided in the game board around the turntable, while the turntable is provided with a recess that matches the object, said recess being located in front of the toy figure when located on the turntable.

The invention will now be explained in further detail with reference to the drawing, wherein FIG. 1 shows a first embodiment of a toy figure according to the invention arranged on a game board that constitutes an element of a game according to the invention;

Figure 1:
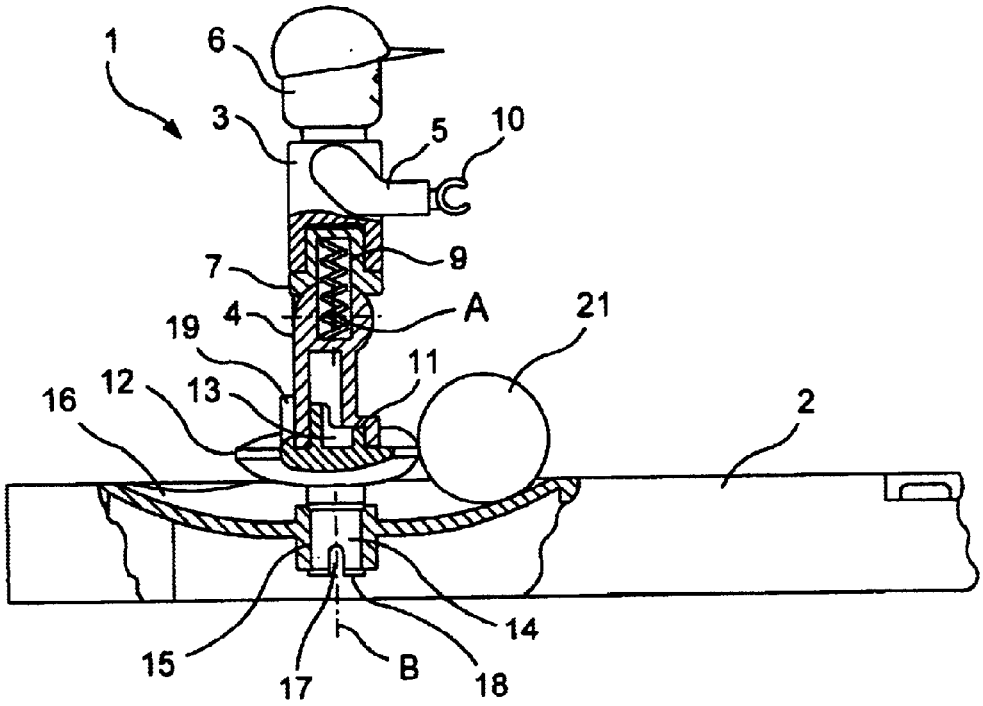

FIG. 1 shows a preferred embodiment of a toy figure 1 according to the invention arranged on a game board 2 that constitutes an element of a game according to the invention. The toy figure 1 is shown in a partially sectional view to Illustrate the structure of this preferred embodiment.

The toy figure 1 comprises a body 3, preferably two legs 4, two arms 5—only one of which being shown in FIG. 1, and a head 6. All the parts are preferably made of a hard plastics material, but they may just as well be manufactured from other materials, such as wood or metal.

Between the body 3 and the legs 4 a spacer element 7 is arranged that extends upwards into a cavity in the body 3 and is securely mounted thereto. The spacer element is configured with a central coupling element 8 (see FIG. 6) that extends downwards between the legs 4 and via a not shown device ensures that the body 3 is able to pivot forwards as well as backwards in relation to the legs 4 about a horizontal axis A situated in the hip portion of the toy figure 1. As will appear from FIG. 6, the legs 4 are preferably assembled to one unit via a connecting element 8, and the device for ensuring the rotation between the body 3 and the legs 4 is preferably constituted by cams and recesses provided in the legs 4 and spacer element 7, respectively.

In FIG. 1, the lower part of the body 3, the legs 4 and the spacer element 7 are shown in a partially sectional view. As will appear the legs 4 are configured with a downwardly oriented cavity, while the spacer element 7 is configured with an upwardly facing cavity. A helical spring 9 is provided in the cavities of the legs 4 and the spacer element 7, respectively, so as to extend axially downwards into the legs 4 and upwards into the body 3. The toy figure 1 can be provided with one helical spring 9, but preferably two helical springs 9 are provided that extend downwards into each their leg 4 and upwards into two cavities provided in the spacer element 7.

The helical spring 9 continues to allow the body 3 to pivot in relation to the legs 4 about the axis A, but it strives to keep the body upright relative thereto. This means that if the body, when an influence is exerted thereon, is caused to deviate from the upright position shown in FIG. 1, the helical spring 9 will cause the body 3 to revert to the upright position when the influence is no longer applied. In this manner the body 3 can be caused to swing resiliently forwards as well as rearwards in relation to the legs 4 about the axis A.

The helical spring 9 can be substituted by other spring devices, such as a leaf spring, a rubber spring or the like that will be able to serve the same purpose: that of striving to keep the body 3 in its upright condition in relation to the legs 4.

The arms of the toy figure 1 is, in the embodiment shown, provided with "hands" 10 that are configured as an annular segment that will, by squeezing, seize around bar-shaped objects. However, this functionality is not a part of the present invention and will not be described in further detail herein.

Besides, the toy figure 1 is provided with coupling means 11 underneath the legs 4, such that the toy figure 1 can be interconnected with other elements, such as a turntable 12 as shown in FIG. 1. The coupling means 11 of the legs 4 are configured as cavities that are able to receive coupling studs 13 provided on another element.

Figure 2:
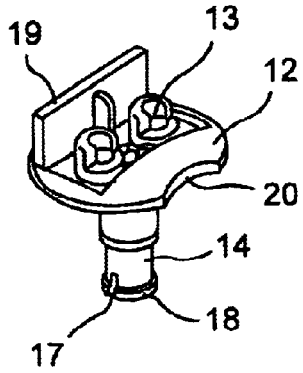
FIG. 2 shows the turntable on the game board shown in FIG. 1, in a perspective view.

The turntable 12 is shown in a perspective view in FIG. 2 and will be described with reference to both FIG. 1 and FIG. 2.

The turntable 12 that is preferably made of a hard plastics material is provided with a downwardly oriented snap-stud 14 that fits into an opening 15 located centrally in a dish-shaped indentation 16 provided in the game board 2.

The snap-stud 14 is, at its extreme end, provided with a slit 17 and outwardly protruding collars 18 that precisely allow the snap-stud 14 to snap-lockingly engage with the opening 15 in the game board 2 after having been introduced axially therein.

Also, the turntable 12 is configured with the previously mentioned upwardly extending coupling studs 13 that are, in the embodiment shown, adapted particularly to the cavities in the legs 4 of the toy figure 1, as will appear from FIG. 1. Besides, a support wall 19 is provided that supports the rear of the legs 4 of the toy figure 1.

The diameter of the snap-stud 14 is preferably adapted to the diameter of the opening 15 in such a manner that rotation is allowed between these parts. Thus, the turntable 12 is able to rotate freely about a vertical axis B.

Finally, the turntable 12 is provided with a recess 20 located in front of the coupling studs 13 and the function of this will be described below.

As will appear from FIG. 1 a toy figure 1 is, in a preferred embodiment, arranged on a game board 2 provided with a freely rotatable turntable 12. Moreover, an object in the form of a spherical element 21 is provided, and as will appear it has rolled into the dish-shaped indentation 16 and abuts on the recess 20 provided on the turntable 12. As a starting point the spherical element 21 may have been positioned anywhere on the game board 2; however, for the sake of practicalities, it will would always tend to roll into the dish-shaped indentation 16 around the turntable 12. If the spherical element 21 does not by itself abut on the recess 20 of the turntable 12, such position could be accomplished by rotation of the turntable 12 about the vertical axis B. When the spherical element subsequently abuts on the recess 20 of the turntable, further rotation of the turntable about the vertical axis B would cause the spherical element 21 to follow such that the spherical element 21 is secured in a position immediately in front of the toy figure 1 irrespective of the rotation of the turntable 12 as such.

Figure 3:
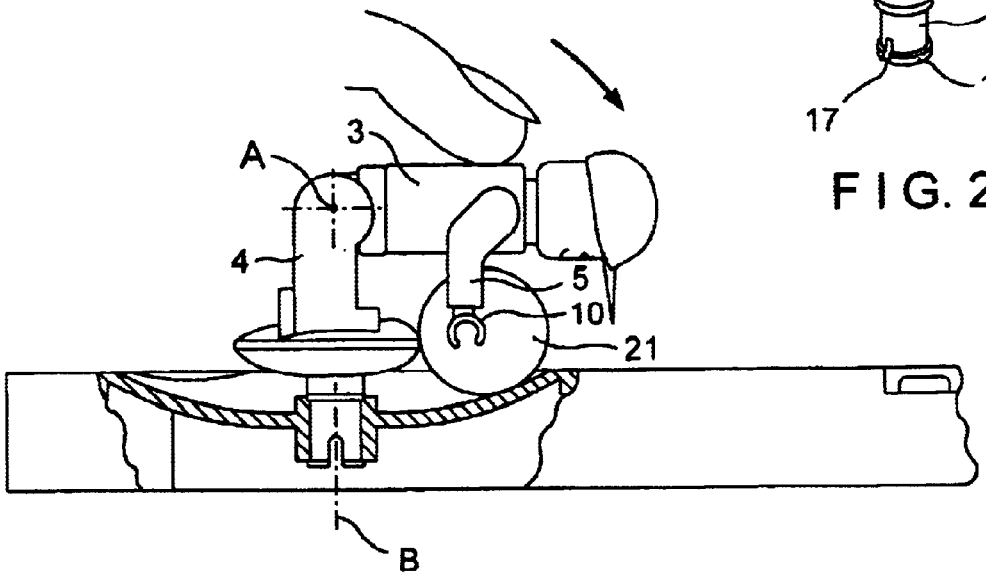
FIG. 3 shows the same as FIG. 1, wherein the toy figure bends over to pick up a spherical element.

In accordance with the invention the body 3 of the toy figure 1 is configured for being able to pivot forwards as well as backwards about a horizontal axis A and this property is made use of for making the toy figure 1 pick up the spherical element 21 as shown in FIG. 3. The body 3 of the toy figure 1 is influenced eg by a finger, as shown, to force the body 3 away from the upright position shown in FIG. 1 to the hunched position shown in FIG. 3. The arms 5 and hands 10 of the toy figure 1 are configured such that they are pressed past the widest place on the spherical element 21 and are caused to loosely engage "behind" the spherical element 21 when the toy figure 1 occupies the hunched position shown in FIG. 3. When the influence of the finger on the toy figure 1 is relieved, the helical spring 9 causes the body 3 to revert to its upright position again while the toy figure 1 carries the spherical element 21 in its arms 5.

Figure 4:
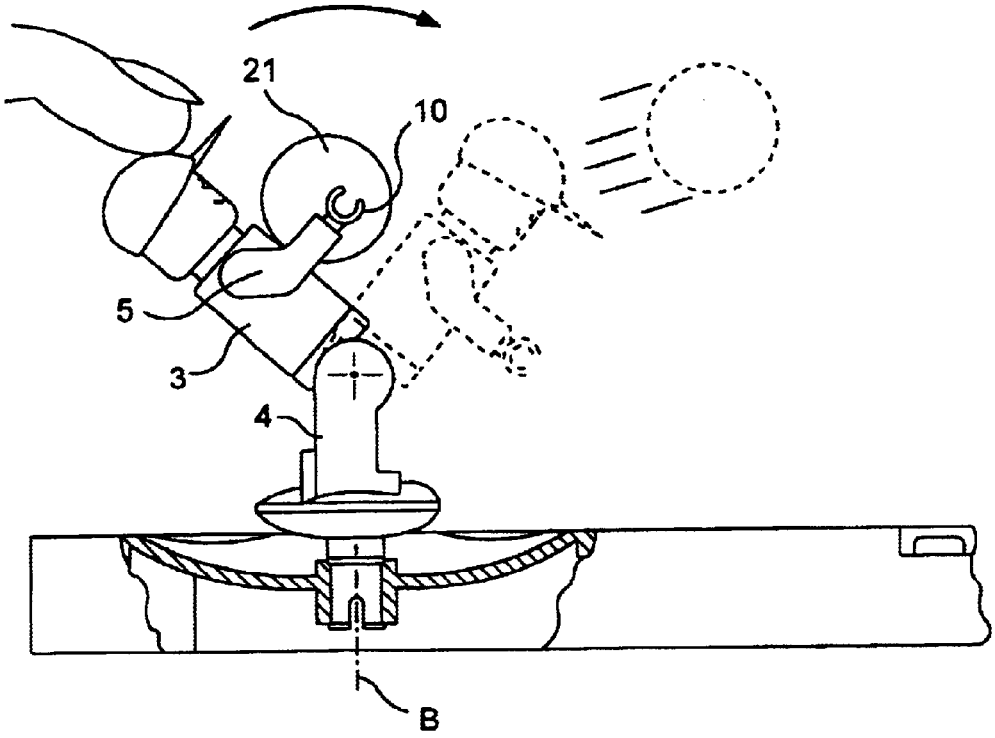
FIG. 4 shows the throwing movement with the toy figure shown in FIGS. 1 and 3.

When the toy figure 1 has picked up the spherical element 21 and is in its upright position the body 3 may, eg by means of a finger, be influenced by a force that causes the body 3 to swing backwards in relation to the legs 4. This position is shown in FIG. 4. If the influence is removed suddenly by the finger being removed quickly, the helical spring 9 will cause the body 3 to quickly swing upwards to a point slightly above vertical position in order to subsequently swing quickly back to vertical position. This quick forwardly pivoting movement and the subsequent sudden braking make the spherical element 21 disengage from the arms 5 and hands 10 of the toy figure 1 and eject forwards as outlined by dashed lines in FIG. 4.

Figure 5:
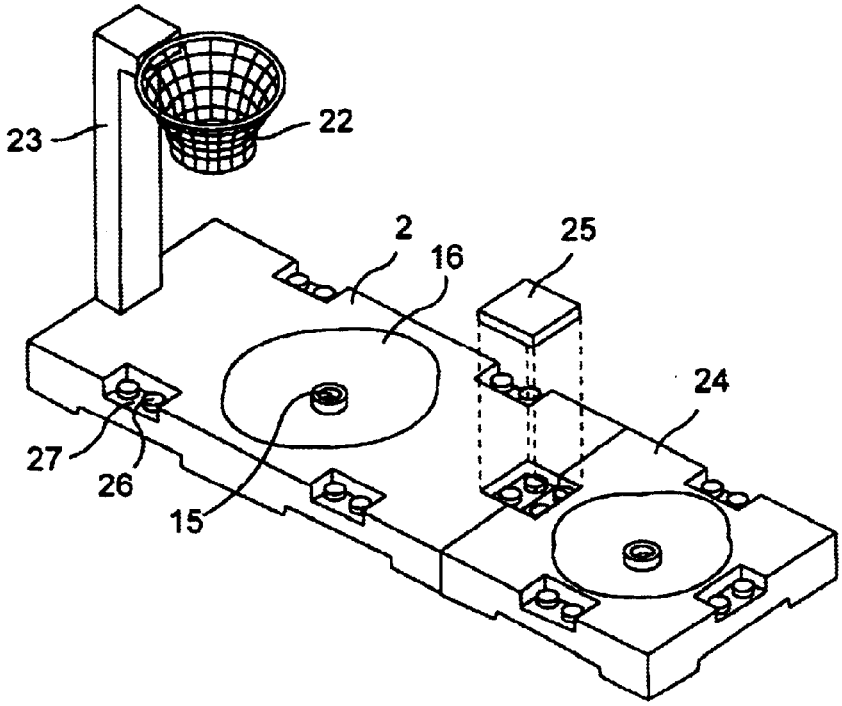
FIG. 5 shows a game board with a basket ball hoop as goal.

FIG. 5 shows a game board 2 with a basket ball hoop 22 as goal for use in a game according to the invention. The game board 2 is identical with the game board 2 shown in FIGS. 1, 3 and 4; however, it is shown without the turntable 12 and the toy figure 1. As will appear, the game board 2 is provided with a tower 23 on which the basket ball hoop 22 is mounted. It is further demonstrated that the game bard 2 can be interconnected with other game boards, such as the game board 24 which is, in the example shown, half the size of the game board 2. The interconnection is effected by means of a coupling element 25, whose underside can be frictionally coupled to upwardly extending coupling studs 26 provided in recesses 27 on the top face of the game boards 2, 24.

Each game board 2, 24 is provided with a dish-shaped indentation 16 with a central opening 15 in which a turntable 12 can be mounted as shown in FIGS. 1, 3 and 4. The number of game boards 2, 24 can of course be varied as desired, since it is possible—by interconnection of a large number of game bards 2, 24—to build an entire basket ball field with many toy figures 1 (players) and two basket ball hoops 22. As it is possible to vary the force by which the spherical element is ejected by pressing the body 3 more or less rearwards for ejection, and since the toy figure 1 is able to rotate about a vertical axis, it is possible to accomplish a controlled throw of the spherical element 21. It is thus possible to throw the spherical element 21 from toy figure 1 to toy figure 1 until one throws the ball 21 up into the basket ball hoop 22 Due to the dish-shaped indentations 16 provided in the game boards 2, 24, the ball 21 will always roll into one of them, whereby it is possible for a toy figure 1 to pick it up and throw it on.

Figure 6:
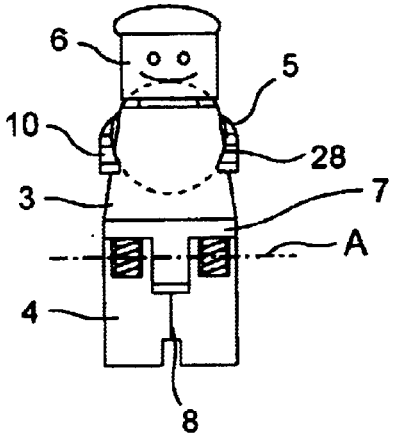
FIG. 6 shows the toy figure shown in FIGS. 1, 3 and 4, seen in a front view.

FIG. 6 shows a preferred embodiment of the arms 5 and hands 10 of the toy figure 1, seen from the front. As will appear, the arms 5 and the hands 10 are configured such that parts 28 thereof form parts of a spherical indentation in which the spherical element 21 is able to sit loosely or optionally be secured by slight friction.

Figure 7:
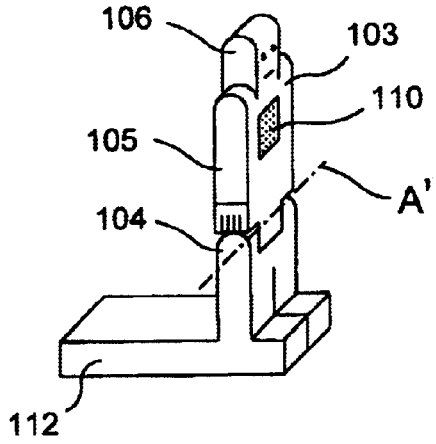
FIG. 7 shows an alternative embodiment of a toy figure according to the invention.
Figure 8:
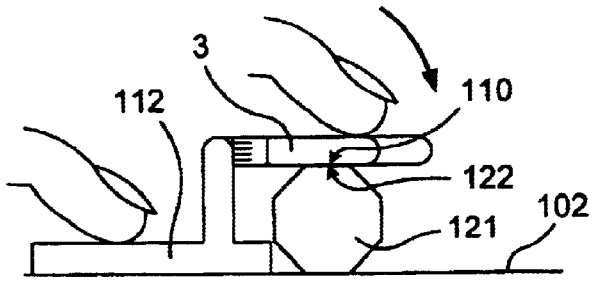
FIG. 8 shows the toy figure shown in FIG. 7 while picking up an object.
Figure 9:
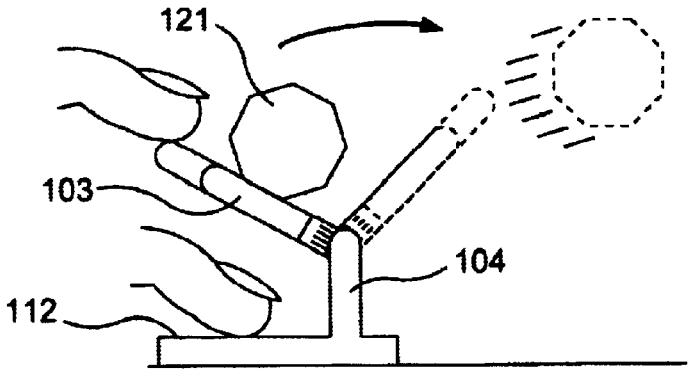
FIG. 9 shows the toy figure shown in FIGS. 7 and 8 while throwing the object.

FIGS. 7–9 show an alternative embodiment of a toy figure according to the invention. This toy figure 101 is more stylised than the toy figure 1 shown in FIGS. 1–6, but it functions in accordance with the same principles when an object is being thrown.

As will appear from FIG. 7 the toy figure 101 comprises a body 103 and legs 104 that are mutually rotatable about a horizontal axis A'. The body 103 is provided with arms 105 and a head 106 made integrally with the body 103. The legs 104 are provided with a rearwardly oriented holder plate 112, the function of which will be described below.

Furthermore, the body 103 is provided with a permanent magnet 110 that is used for temporarily securing an object with magnetic areas before it is thrown as described below.

Like the toy figure 1 shown in FIGS. 1–6, the toy figure 101 also comprises a spring device that strives to keep the body 103 upright. The spring device is not shown, but like the spring device shown in FIG. 1 it may consist of one or more helical springs, a leaf spring, a rubber spring or other suitable spring devices that are connected to the body 103 and the legs 104.

FIGS. 8 and 9 show how the toy figure 101 is used while picking up and throwing a magnetic object, such as an octagonal "ball" 121. The toy figure 101 is kept in place against a support 102 by a first finger being pressed down towards the holder plate 112 as shown in FIG. 7. In this manner the legs 104 are secured, and it is now possible, by another finger, to press the body 103 forwards to cause the permanent magnet 10 into magnetic contact with a magnetic area 122 on the octagonal ball 121.

When the pressure on the body 103 is relieved, the integral spring device will cause the body 103 to swing upwards to its upright position with the ball 121 temporarily secured on the permanent magnet 110.

FIG. 9 shows how the body 103 can be forced backwards relative to the legs 104 that are still secured by a pressure on the holder plate 112. If the body 103 is suddenly let go, the integral spring device will cause the body 103 to swing quickly forward and throw the ball in the same manner as described with reference to FIG. 4.

When the toy figure 101 is used in a game it does not necessarily have to occupy a specific position on a game board. Thus, the game may proceed by the ball 121 landing anywhere on a support, and the toy figure 101 is moved to a position behind the ball 121 in relation to the direction in which it is desired that it be thrown. Then the toy figure 101 is secured by a pressure exerted on the holder plate 112 and the ball 121 is picked up and thrown as shown in FIGS. 8 and 9.

Figure 10:
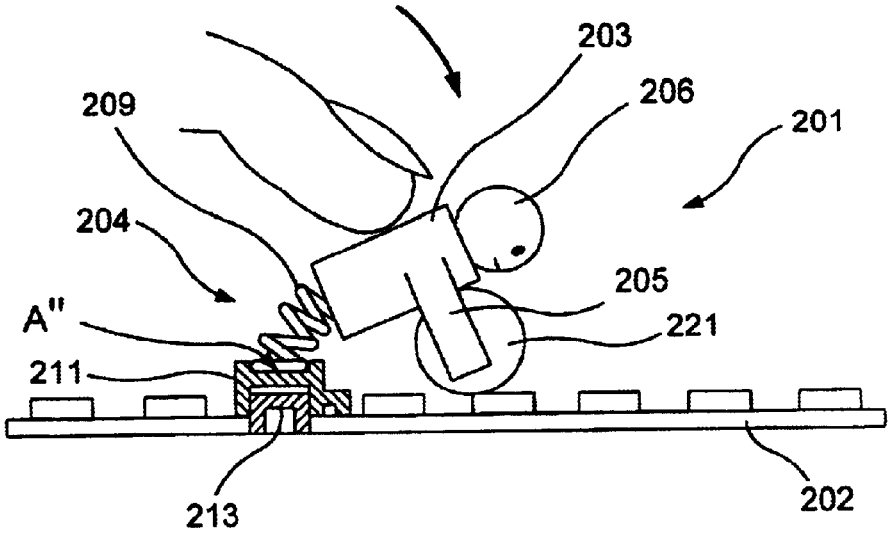
FIG. 10 shows yet an alternative embodiment of a toy figure according to the invention while picking up and object.
Figure 11:
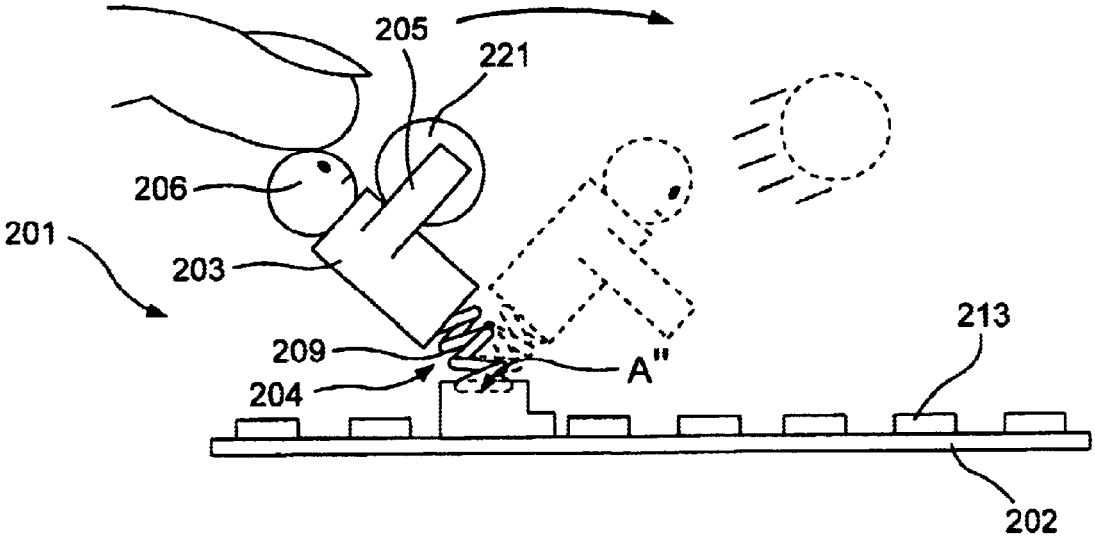
FIG. 11 shows the toy figure shown in FIG. 10 while throwing the object.

FIGS. 10–11 show yet an alternative embodiment of a toy figure according to the invention. This toy figure 201 comprises a body 203 that is provided with arms 205 and a head 206. The toy figure 201 is also provided with legs 204 that, in this alternative embodiment, consist of a helical spring 209 that also constitutes the spring device as such that seeks to keep the body 203 upright. The helical spring 209 is connected to the body 203 and to a foot 212 provided with coupling means 211 in the form of a cavity 211 enabling it to be interconnected to a coupling stud 213 provided on a game board 202 as shown in FIG. 10.

FIG. 10 shows how the toy figure 201 is used during picking up of a ball 221, a finger being used to press the body 203 forwards to enable the arms 205 to pick up the ball 221. The arms 205 can be configured like those of the toy figure shown in FIGS. 1, 3, 4 and 6, or they may be configured in another way to obtain temporary securing of the ball 221.

Since the legs 204 consist of a helical spring 209, the body 203 rotates about an axis A" located in a lower level than the axes A and A' in the toy figures 1 and 101 described above.

When the pressure on the body 203 is relieved, the helical spring 209 will force the body 203 to pivot to its upright position with the ball 221 temporarily secured between the arms of the toy figure 201.

FIG. 11 shows how the body 203 can be forced backwards by application of a pressure in that direction by a finger. If the body 203 is suddenly let go, the helical spring 209 will cause the body 203 to swing quickly forwards and throw the ball 221 in the same manner as described with reference to the toy figure 1 shown in FIG. 4.

As mentioned, the toy figure 201 can be used in combination with a game board 202 provided with upwardly oriented coupling studs 213, the foot 212 being provided with complementary coupling means 221 as described above and shown in FIG. 10. As will also appear from FIGS. 10 and 11, the game board 202 may be provided with a plurality of coupling studs 213 and thus be configured as a commonly known toy building plate for a toy building set.

The game as such may take place by the toy figure 201 being moved between different positions on the game board 202; it being possible to couple it on any coupling stud 213, or several toy figures 201 may be used that are located so closely that there is always one to pick up the ball 221 and throw it on.

The invention was described with reference to one preferred and alternative embodiments of both a toy figure and a game. Both the toy figure and the game, however, can be configured differently within the scope of the invention; it being possible for instance to use other spring devices, other kinds of objects and other means for temporarily securing the object to the body of the toy figure.

What is claimed is:

1. A human-like toy figure (1; 101; 201) comprising a body (3; 103; 203) and legs (4; 104; 204) configured such in relation to each other that, in the upright position of the toy figure, the body (3; 103; 203) is turnable about an essentially horizontal axis (A; A'; A"), in which toy figure (1; 101; 201) there is, in connection to the body (3; 103; 203), provided inflexible means for temporarily securing an object (21; 121; 221), characterised in that the toy figure (1; 101; 201) is provided with a spring device that strives to keep the body (3; 103; 203) upright in relation to the legs, but allows the body (3; 103; 203) to swing resiliently forwards as well as backwards about the axis (A; A'; A") so as to enable a temporarily secured object to be thrown from the securing means.

2. A toy figure according to claim 1, characterised in that the toy figure is provided with inflexible legs (4; 104); and that the spring device is provided between the body and legs of the toy figure (1; 101).

3. A toy figure according to claim 2, characterised in that the spring device comprises at least one helical spring (9) extending axially downwards into the legs (4; 104) and upwards into the body (3; 103), respectively.

4. A toy figure according to claim 1, characterised in that the toy figure is provided with flexible legs (204); and that the spring device is constituted by these flexible legs.

5. A toy figure according to claim 4, characterised in that the flexible legs (204) are constituted by a helical spring (209) mounted underneath the body (203).

6. A toy figure according to claim 1, characterised in that the inflexible means for temporarily securing an object (21; 221) are configured as two arms (5; 205).

7. A toy figure according to claim 6, characterised in that the arms (5; 205) are configured for being securely locked in specific positions in relation to the body (3; 203).

8. A toy figure according to claim 6, characterised in that the arms (5; 205) are securely mounted in relation to the body (3; 203).

9. A toy figure according to claim 8, characterised in that parts of the arms (5; 205) extend essentially straight from the body (3; 203).

10. A toy figure according to claim 9, characterised in that parts of the arms (3) are configured such that they form parts of a spherical indentation (28) in which a spherical element (21) is able to sit freely.

11. A toy figure according to claim 1, characterised in that the inflexible means for temporarily securing an object (121) comprises at least one permanent magnet (110).

12. A toy figure according to claim 1, characterised in that the toy figure (1) is provided with coupling means (11; 211) underneath its legs.

13. A game comprising at least one goal (22) and at least one human-like toy figure (1; 101; 201) comprising a body (3; 103; 203) and legs (4; 104; 204) and an object (21; 121; 221) intended to be thrown towards the goal (22) by the toy figure (1; 101; 201), characterised in that the toy figure (1; 101; 201) is configured in accordance with claim 1.

14. A game according to claim 13, characterised in that it comprises a game board (2; 202); and that the game board (2; 202) and the toy figure (1; 201) are configured with complementary coupling means (11, 13; 311; 213), the coupling means (11; 211) of the toy figure (1; 201) being configured underneath the legs (4; 204).

15. A gam according to claim 14, characterised in that the game board (2) is provided with at least one rotatable turntable (12) provided with the complementary coupling means (13) of the game board.

16. A game according to claim 15, characterised in that an indentation (16) is provided in the game board (2) around the turntable (12); and that the turntable (12) is provided with a recess (20) that matches the object (21), said recess (20) being located in front of the toy figure (1) when located on the turntable (12).

* * * * *